US008128812B2

(12) United States Patent
Takuma

(10) Patent No.: US 8,128,812 B2
(45) Date of Patent: Mar. 6, 2012

(54) FLOATING MATERIALS REMOVAL SYSTEM

(76) Inventor: Norikata Takuma, Kokubunji (JP)

( * ) Notice: Subject to any disclaimer, the term of this patent is extended or adjusted under 35 U.S.C. 154(b) by 814 days.

(21) Appl. No.: 12/000,473

(22) Filed: Dec. 13, 2007

(65) Prior Publication Data

US 2009/0014367 A1 Jan. 15, 2009

(30) Foreign Application Priority Data

Jul. 10, 2007 (JP) ..... 2007-180494

(51) Int. Cl.
*E02B 5/08* (2006.01)
*B09B 3/00* (2006.01)

(52) U.S. Cl. ... 210/112; 210/158; 210/160; 210/170.11; 210/251

(58) Field of Classification Search ..... 210/112, 210/158, 160, 161, 170.11, 391–393, 251; 134/127, 128, 131
See application file for complete search history.

(56) References Cited

U.S. PATENT DOCUMENTS 4,264,240 A * 4/1981 Alexander ..... 406/85
5,618,415 A * 4/1997 Johnson, Jr. ..... 210/158
5,980,735 A * 11/1999 Bratten ..... 210/87

FOREIGN PATENT DOCUMENTS

JP 08-338204 12/1996
JP 10-245834 9/1998
JP 2004-225482 8/2004
JP 2004-232379 8/2004
JP 2004-255313 9/2004
JP 2004-278144 10/2004

* cited by examiner

*Primary Examiner* — Terry Cecil
(74) *Attorney, Agent, or Firm* — Shlesinger Arkwright & Garvey LLP

(57) ABSTRACT

This invention comprises a main rotating removal screen that catches floating materials such as big jellyfishes, wood chips, waste plastics and other things floating in water by endless rotation and including nets that move the floating materials caught to a position higher than the water surface, a receiving tray is provided for receiving the floating material caught by the main rotating removal screen and sending it to a discharge line, a secondary lifting device is provided that cooperates with above mentioned main rotating removal screen to lift and transfer the floating materials caught by the receiving tray, a water jet system is provided for dislodging any caught floating materials that is lifted higher than the receiving tray when it is hooked on the rotating removal screen and not released to the receiving tray, and a cutting water jet system is provided to cut oversized floating material into an acceptable size.

8 Claims, 6 Drawing Sheets

FLOATING MATERIALS REMOVAL SYSTEM

FIELD OF THE INVENTION

This invention relates to a floating materials removal system, which removes floating materials such as big jellyfishes, wood chips, waste plastics and other things floating in the neighborhood of the intake of cooling water in power plants or factories.

BACKGROUND OF THE INVENTION

In a power plant using seawater as cooling water, returning warm water from the power plant to the sea produces jellyfishes and they block water intake. In such cases smooth water intake cannot be attained. In order to solve this problem various systems were proposed in the past as indicated below. However these systems were not good enough to solve the problem. Recently the appearance of very big ECHIZEN jellyfishes (scientific name is Stomolopus-Nomurai) which have more than two meters diameter umbrella and more than 150 Kg weight have become not only a nuisance for fishermen but also a problem for power plant and other plants.

Various systems now employed are as follows.

The Power plant lowers the temperature of returning seawater and prevents the growth of jellyfishes (Japanese Patent Publication Heisei 08-338204).

A System, which has a reverse jet stream toward the sea that moves out jellyfishes caught by the screen and which is installed at the intake for the seawater and that prevents the inflow of jellyfishes (Japanese Patent Publication Heisei 10-245834).

A Jellyfish ground system, which grinds jellyfishes in the seawater and the solid portion of this ground material is flocculated and settled by chemicals, and the separated waste water is returned to public water line (Japanese Patent Publication 2004-255313).

A Jellyfish inflow preventing system, which has a curtain wall the curtain wall and the wall side flow produced by the curtain wall collects jellyfishes in the so-called jellyfish remaining area (Japanese Patent Publication 2004-278144).

A Jellyfish inflow preventing system, which has a moving curtain that secures enough open space for water the intake (Japanese Patent Publication 2004-225482).

A Seawater intake system, which detects jellyfish, other living things and waste, and then transfers these things to the big capacity removing vessel both continuously and automatically (Japanese Patent Publication 2004-232379).

After analyzing the above examples the following conclusions are obtained.

In order to remove the disturbing floating materials efficiently, the following actions have to be simultaneous (1) Catching the floating materials instantly.

(2) Releasing the caught floating materials efficiently and transferring them to the water discharge line smoothly.

In the prior art only (1) is emphasized and (2) is not considered sufficiently, therefore untreated floating materials accumulates in the system and the whole system may be stopped when the volume of the floating materials becomes larger than a certain limit. Consequently the preferred system has to satisfy (1) and (2) simultaneously.

The previous technologies were reviewed regarding a main rotating removal screen which collects floating materials by endless rotation and the floating materials so caught being conveyed to a position higher than water surface. No prior art technology was found in this category.

BRIEF SUMMARY OF THE INVENTION

The objective of this invention is to provide a new floating materials removal system which catches the floating materials instantly and releases the floating materials caught efficiently and the receiving tray, which receives the floating materials caught, can cut the floating materials such as jellyfishes into smaller pieces and transfer them to the discharge line.

In order to accomplish the objective above, the floating materials removal system in this invention is characterized by having a main rotating removal screen which catches the floating materials such as big jellyfishes and transfers the floating materials caught to a higher position than the water surface by endless rotation, and also having a receiving tray which receives the floating materials caught by the main rotating removal screen and transfers them to the discharge line.

Furthermore, it is possible to add a secondary lifting device which cooperates with main rotating removal screen mentioned above to transfer floating materials to the receiving tray, or to add a water jet system to drop down the floating materials caught by the rotating removal screen, but not released from it and lifted to a higher position than the receiving tray, or to provide a cutting water jet system on the receiving tray to cut the floating materials that has been caught into smaller pieces.

The cutting water jet system mentioned above is provided with a control system to start and stop the cutting water jet. The Jetting surface for the cutting water can be divided in to several areas, and the cutting water control system can be designed to control the jet and to stop it according to the control unit and at one or several of the above mentioned areas.

Furthermore, the above mentioned control system is provided with a sensor to detect the existence of the floating materials caught, and an electromagnetic valve is installed in the cutting jet water supply line and a control circuit is provided to open the above mentioned electromagnetic valve electrically based upon a signal of the above mentioned sensor and to close the above mentioned electromagnetic valve after a predetermined time interval or after the disappearance of the object detected by the above mentioned sensor.

The floating materials removal system in this invention has a main rotating removal screen which catches the floating materials in the water and simultaneously transfer the caught floating materials to a higher position than water surface by endless rotation, and a receiving tray is provided which receives the floating materials caught by the main rotating removal screen and sends it to the discharge line.

In the instance where the water drawing line and water intake line are installed as L shape like FIG. 1, seawater in the water drawing line flows into the main removal rotating screen through the side surface and leads to the water intake line through the eyes (holes) provided in the wall surface of the screen, and the floating materials in seawater are hooked and caught on the inside wall surface of the main rotating removal screen by the water pressure of the flowing water and the floating materials so caught are then conveyed to a higher position than the water surface by the rotation of the main rotating removal screen and transferred to the discharge line through the receiving tray.

Accordingly, removal of the floating materials is accomplished effectively. Particularly blockage of the screen by the hooked floating materials does not occur and water feed to the water intake line is always maintained and a stable water supply to the power plants and factories can be accomplished.

Furthermore, a secondary lifting devise may be installed which lifts and transfers the floating materials caught to the receiving tray together with the main rotating removal screen, the floating materials caught by the main rotating removal screen are securely lifted to the height of the receiving tray and transferred to the receiving tray effectively.

Since the water jet system is installed to force dropping of the floating materials caught by the rotating removal screen but that is still hooked to the screen and does not to fall to the receiving tray, the floating materials caught can always be effectively transferred to the receiving tray.

Since the receiving tray has the cutting water jet system to cut the floating materials caught into smaller pieces, removal of floating materials caught such as big jellyfishes can be performed effectively and easily.

This cutting water jet system is designed to have a control system to control the jet and to stop the cutting water, and the jet surface of cutting water is divided in to several areas with a control system to jet and stop the cutting water depending on the one or the plural control unit as divided above.

For example, if the control system of the present invention has a sensor to detect the existence of the floating materials caught, an electromagnetic valve is provided on the supply line of the cutting water to the cutting water jet system, a control circuit is also provided to open the electromagnetic valve based on the detecting signal of the above mentioned sensor and to shut the above mentioned valve after a predetermined time interval or after disappearance of the object detected by the above mentioned sensor, it is then possible to jet high pressure water only when the above mentioned sensor detects that the floating materials caught and only from the cutting water jet panel within a designated area, therefore application of the water jet to unnecessary area is avoided, and the operation can be done effectively and economically.

DETAILED DESCRIPTION OF THE INVENTION

Figure 1:
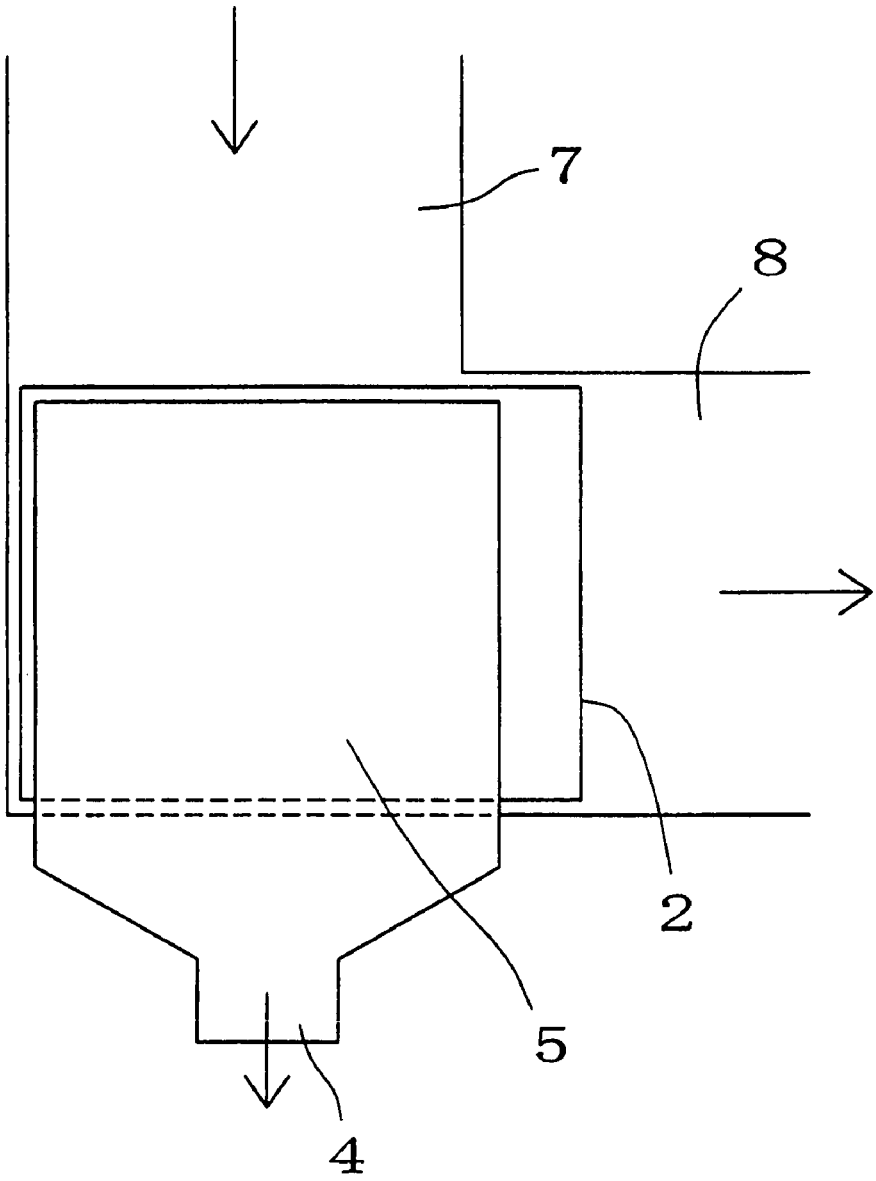
FIG. 1 is a schematic top plan view showing the structure of this invention.
Figure 2:
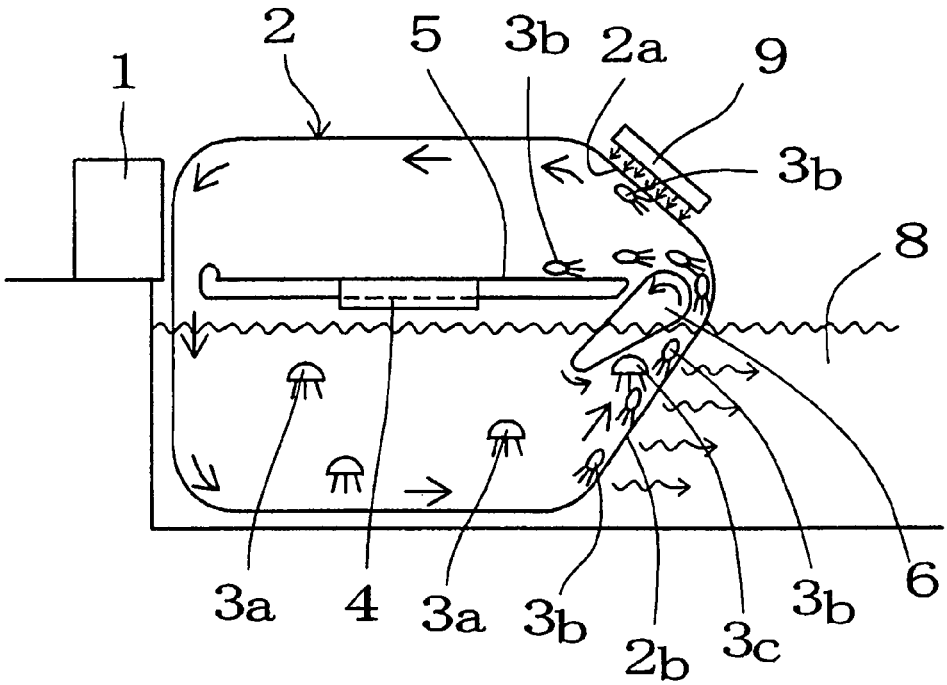
FIG. 2 is a side view of FIG. 1.
Figure 3:
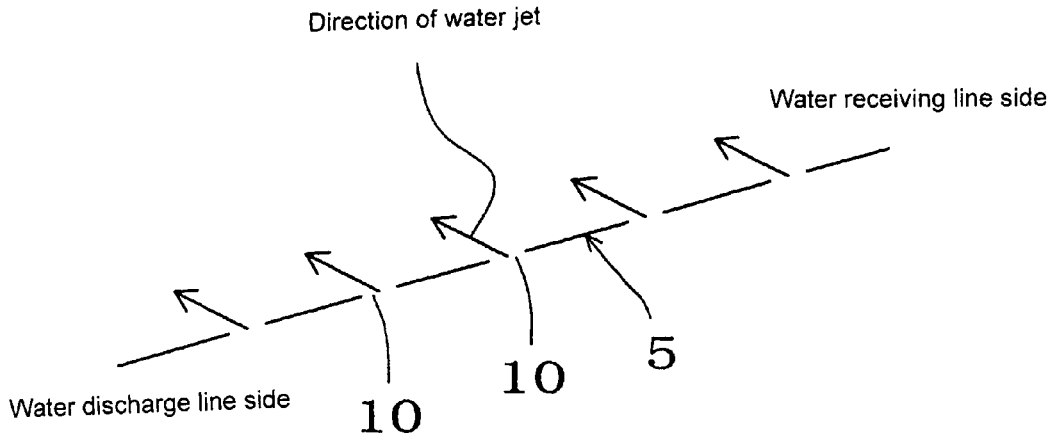
FIG. 3 is a conceptual figure showing the main portion of the receiving tray.

The floating materials removal system based on this invention is explained in FIG. 1 through FIG. 3. FIG. 1 is flat view to show the whole concept. FIG. 2 is side view of the same and FIG. 3 is the conceptual figure to show the main part of receiving tray.

This floating materials removal system comprises a short tube type main rotating removal screen 2 which catches the floating materials 3*a* in the water by endless rotating motion, and conveys the floating materials caught 3*b* to a higher position than water surface by the endless rotating motion operated by the operation board 1, a receiving tray 5 which receives the floating materials caught 3*b* by the above mentioned main rotating removal screen 2 and transfers it to the discharge line, and a secondary lifting device 6 is provided which lifts and places the floating material caught 3*b* on the receiving tray 5 together with the above mentioned main rotating removal screen 2. The secondary lifting devise 6 is designed to operate endlessly and continuously in the same speed and direction of the main rotating removal screen.

The above mentioned floating materials removal system is installed in the L shaped intersection of a water drawing line 7, which draws seawater from the sea for use as cooling water, and a water intake line 8 to power plant (factory). Consequently seawater from the water drawing line 7 is fed to the main rotating removal screen 2 from a side surface and led to the water intake line 8 through the eyes (holes) provided on the wall surface of screen 2.

The floating materials 3*a* in the seawater is are hooked and caught on the inside wall of the main rotating removal screen 2 by the water pressure of the flowing water, the floating material caught 3*b* is then conveyed to a position higher than water surface due to the rotation of the main rotating removal screen 2.

When transferring the materials to the position higher than water surface by only the main rotating removal screen 2, the following problems may be seen frequently.

Among the floating materials caught 3*b* by the main rotating removal screen 2, much of the materials 3*b* are caught weakly and they can be easily separated by a small wave on the water surface or by contact with the air and they may coagulate and adhere to the wall surface of the main rotating removal screen 2 and some may remain and float on the water surface. When the volume of these remaining and floating materials become large, floating materials caught 3*b* by the main rotating removal screen 2 with strong force can be scraped down, which is not desirable and when the situation gets worse, the system may become non-operational.

Therefore in the floating material removal system in this example, the above mentioned serious problem is to be solved by the introduction of a secondary lifting device 6.

The floating materials removal system in this example has a secondary lifting device 6 which rotates in the same direction and at same speed as the main rotating removal screen 2 and this device is installed against the main rotating removal screen 2 as shown in the figure. With cooperation of the secondary lifting machine 6 and the main rotating removal screen 2, the above mentioned accumulated and floated floating materials caught 3*b* and the floating materials 3*c* in the adjacent water surface can be clipped up from both sides and transferred to the receiving tray 5.

The above mentioned rotating removal screen 2 can be anything which permits the passage of seawater but also catches the floating materials 3*a* in that seawater. For example mesh belt composite, composite of net whose edge is adhered to non edge material, caterpillar type endless composite made by the combination of a required number of small frames covered by net, a small frame covered by the board which has round holes or long circular holes, or a small frame covered by lots of rods or other composites can be utilized.

The above mentioned receiving tray 5 is maintained in a sloped position over the water surface by a supporting stand (not shown in the Figure) and moves the floating materials caught 3*b*, which it receives from the co-work of the above mentioned rotating removal screen 2 and the secondary lifting device 6, to the discharge line 4 by the above mentioned slope. This receiving tray 5 can be positioned correctly by buoyancy.

Furthermore the above mentioned rotating removal screen 2 is designed such that the part of it at 2*b*, moving through the water from the bottom of the water has a slope that declines toward the downstream direction, so that floating materials 3*a* in the water can be easily aggregated in the neighborhood of the water surface. By this measure, the above mentioned lifting function is kept in the better condition.

On the upper portion 2*a* of the above mentioned rotating removal screen 2, a water jet system is installed to make it easy to drop floating materials caught 3*b* on the receiving tray 5 when the floating materials caught 3*b* are hooked and not released from the rotating removal screen 2 and brought to the higher position than the receiving tray 5. Under water pressure the floating materials caught 3*b* are released and dropped from the rotating removal screen 2.

The floating materials removal system mentioned above urges down the caught floating materials 3*b* on to the receiving tray 5 by utilizing the slope of the receiving tray 5. However it is anticipated that this mechanism may not function sufficiently for big jellyfishes such as ECHIZEN jellyfishes, which have recently become a problem. Therefore, additional structure indicated below be used.

For example lots of small holes 10 whose diameter is 1 mm are placed in a 10 cm interval in the x and y directions, and high pressure (for example about 30 atm.) water is jetted from these small holes 10. Jet water direction is angled downstream and in a direction as shown in FIG. 3. Small holes 10 may not only be circles but also slit type holes, and the interval between the holes can be shorter or longer than 10 cm.

Floating materials caught 3*b*, which is are jellyfishes, are cut down to, for example, 10 cm length, by the strong thin water flow from downstream, and jellyfishes so cut are easily floated in a downstream direction by the angled thin jet force. In other words by the means of a high pressure jet stream in a desired direction through small holes, two things are performed simultaneously, the big jellyfishes are cut down to smaller pieces and they are moved by flow down to the next handling direction.

Consequently the situation, where big jellyfishes lifted on the receiving tray 5, aggregate and cannot be handled is thus avoided.

Regarding the cutting water jet system which cuts down jellyfishes by the high pressure jet water through above mentioned small holes 10, it is possible to operate it and to apply the jet water throughout the time the main rotating removal screen 2 is rotated to send the floating materials caught 3*b* to the receiving tray 5. However considering the purpose of this jet stream, it is reasonable and effective to control the jet stream so that it is used only when the floating materials caught 3*b*, needs to be cut, and is on the receiving tray 5, and only when floating materials caught 3*b* exists.

Figure 4:
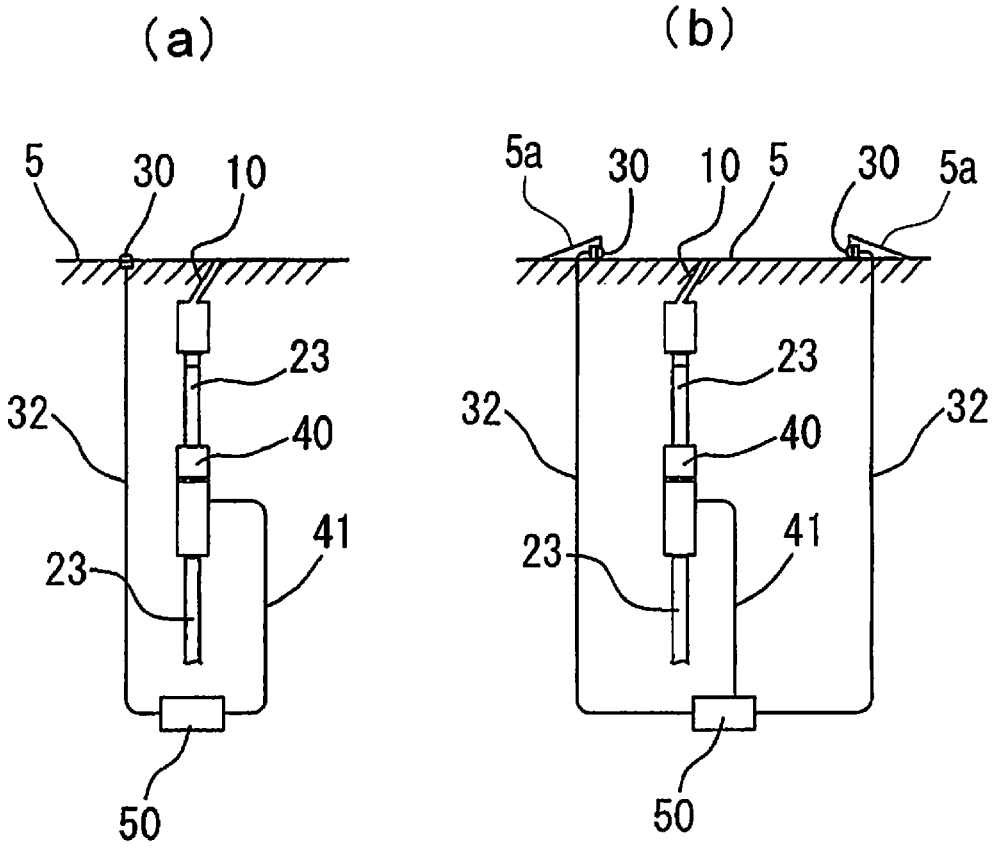
FIG. 4 is a front view of the control arrangement for cutting water jet system.

FIG. 4 shows a example of this control schematically and this sort of control is easily realized by installing the electromagnetic valve 40 in the cutting water supply line to the small holes 10 of the cutting water jet system, and including a simple sensor 30 to detect the floating materials caught such as jellyfishes on the surface of the receiving tray 5, and by opening and closing the electromagnetic valve according to a detecting signal of sensor 30.

For example in the case of using a reflecting type sensor as the sensor 30, the efficient control measure for the cutting jet water system is secured by the sensor 30 whose emitting or signaling surface are installed upright on the receiving tray 5 and the control circuit 50 which opens the electromagnetic valve 40 electrically by the detecting signal of the sensor 30 and shuts the electromagnetic valve 40 according to the predetermined setting.

In the above mentioned control example of using a reflecting type sensor, when the floating materials caught are located over the sensor 30, the detecting signal of sensor 30 is then sent to the control circuit 50 through the sensor cable 23, and it makes the relay switch to an 'on' condition. It then opens the electromagnetic valve 40 which is connected to the control circuit 50 through the electric cable 41 and shuts the electromagnetic valve 40 after the elapse of a predetermined time period or by the disappearance of the detecting object. Therefore the cutting water jet is provided only when the floating material is located over the sensor 30 and cutting is done effectively if the floating material is a jellyfish.

On the above control example, the reflective type sensor is used as sensor 30, however the type of sensor is not limited to a certain type but any type can be used if it can detect the floating materials caught. For example when a passage type sensor (can be called a blockage type sensor) is used, a couple of sensor setting positions 5*a* are installed on the receiving tray 5 and in a manner to not interfere with the flow down of the floating materials caught, and an emitting or signaling unit and receiving unit for emission or signal are installed on the opposite position of the sensor setting positions 5*a*. The detecting signal is sent from the sensor 30 to the control circuit 50, when the floating materials caught are located between these two units. (FIG. 4(*b*))

Of course it is not necessary to have a one to one match among the numbers of small holes 10, with the sensor 30 for control and the electromagnetic valve 40 to control the jet of the cutting water. The Jet surface of the cutting water jet system which has the small holes 10 for the jet water may be divided to an appropriate number of areas, and a sensor 30 and electromagnetic valve 40 are installed to each divided area, in other words, each control unit. It is then possible to control the jet cutting water only when the floating materials caught exist on the jet surface and only in the area where floating materials caught exist.

Figure 5:
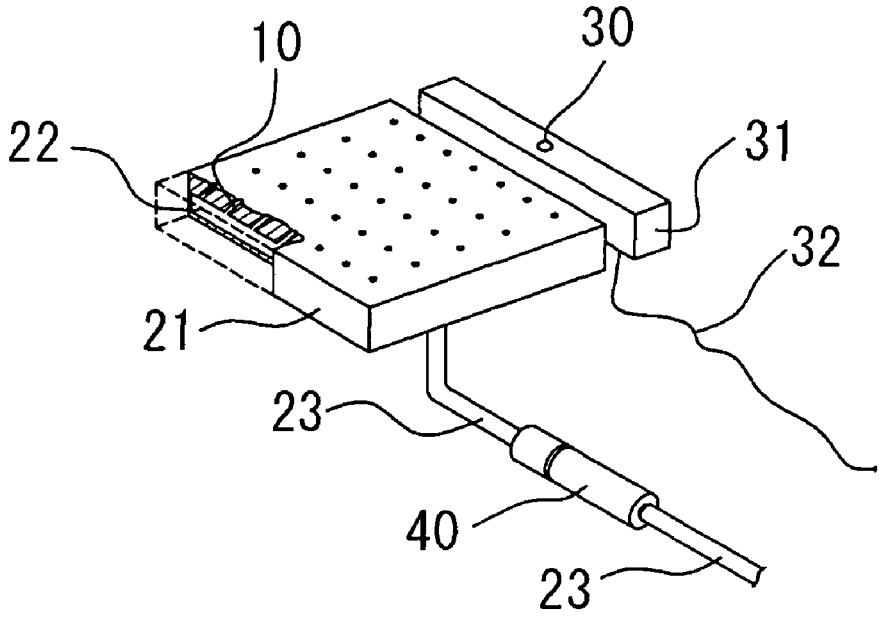
FIG. 5 is perspective view with portions cut away to show an example of components of the cutting water jet system.
Figure 6:
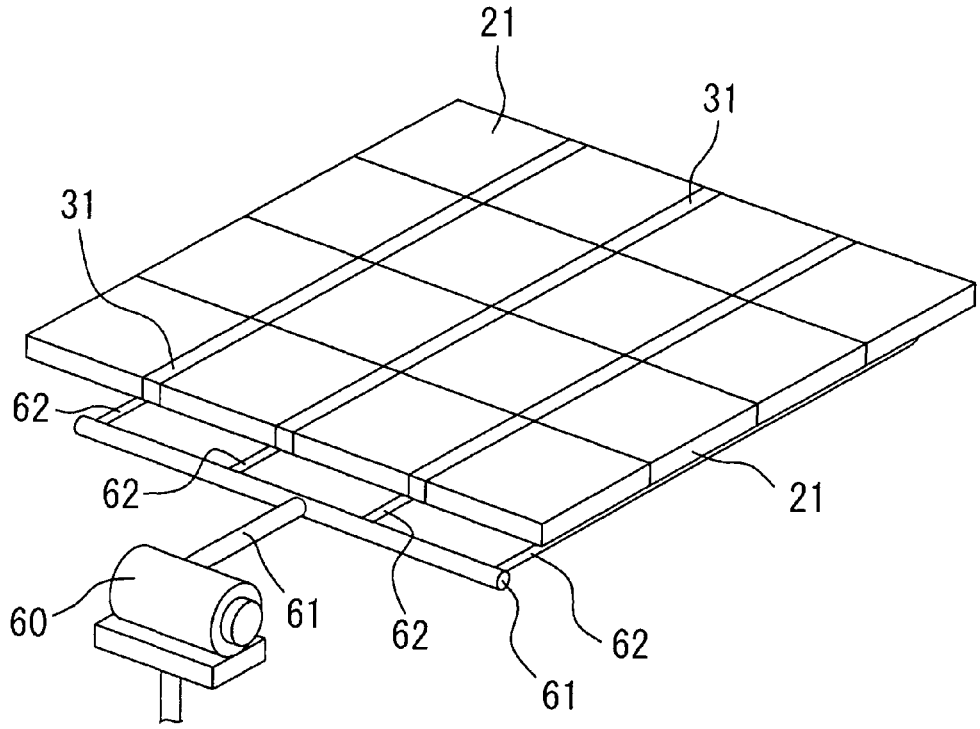
FIG. 6 is a perspective showing an example of the cutting water jet system.

FIGS. 5 and 6 show example of control where jet surface of the cutting water jet system is divided to a desired number of areas, and one divided area corresponds to one control unit. On this example shown in the figures, the cutting water jet panel 21 and the sensor block 31 are combined and installed as jetting surface, and a sheet of cutting water jet panel 21 which has small holes to jet cutting water is regarded as a smallest control unit.

The cutting water jet panel 21 shown in this example is a box type structure which has an inner space where water receiving part 22 is installed. The surface of this panel is holed with a desired number of small holes which are connected to the water receiving part 22. As shown in FIG. 5 this panel is designed to receive high pressure cutting water through water supply branch pipe 23 connected to the water receiving part 22 and to jet high pressure water through small holes 10. The water supply branch pipe 23 has electromagnetic valve 40 installed.

The sensor block 31 is a thin box type structure and sensor 30 (reflective type sensor) is installed on the upper surface of this block and the sensor 30 is connected to a sensor cable 32. In this example as best shown in FIG. 5, height and width of this sensor block are designed to be equal to those of cutting water jet panel 21.

In the cutting water jet system shown in the example figures, it is possible to construct a desired area of jet surface by combining appropriate number of cutting water jet panels 21 and sensor blocks 31. In FIG. 6, four sheets of cutting water jet panel 21 and three pieces of sensor block 31 are combined alternatively in an X direction, which makes a row. And four rows of this combination are placed in a Y direction, which comprises jet surface divided to sixteen areas.

Since jet surface of the cutting water jet system is comprised by combining cutting water jet panel 21 and sensor block 31 as shown in the figures, it is possible to jet high pressure water only to a certain cutting water jet panel in the designated area when sensor 30 detects the floating materials caught. By setting the control circuit beforehand, the number and location of cutting water jet panel 21, which should be opened and shut by the electromagnetic valve 40 is based on the detecting signal raised by each sensor block 31.

Although a reflective type of sensor is used as sensor 30 in the example shown in the figures, other types of sensors, such as passage type sensor, can be easily used. For example, when a passage type sensor is used, it is reasonable to install an optional number of cutting water jet panels 21 between the sensor block which has the emitting or signaling unit and the sensor block which has the emit or signal receiving unit. To secure the required detecting distance, both sensor blocks should be placed in an opposite position.

The upper surface area of the cutting water jet panel 21 and the number of the small holes 10 are determined optionally and the number and the combination structure of the cutting water jet panel 21 and the sensor block 31 are also optional. Furthermore since the number and the location of cutting water jet panel 21 controlled by the detecting signal of individual sensor block 21 can be decided previously, the content of control of the cutting water jet depends perfectly on free choice and decision of the person to practice.

Consequently in the cutting water jet system in the example shown in the figures, it is possible that various types of settings regarding the number and the location of the individual sensor block 31 and the cutting water jet panel 21 which is controlled based on the detecting signal of the sensor block, are memorized to the control circuit, and that different division area pattern of the cutting water jet system are selected or switched depending to the number and the distribution of jellyfishes fed to the receiving tray.

On the example shown in the figures, the electromagnetic valve 40 is installed on the water supply branch pipe 23 connected to the cutting water jet panel 21, and the number of electromagnetic valves installed over the whole area of jet surface is adjusted by the area of the upper surface of the cutting water jet panel 21. The location of the electromagnetic valves can be selected freely on the supply line of the cutting water to the cutting water jet panel 21, and it is possible to expand the area of the control unit division by the location of an electromagnetic valve and to adjust the number of the electromagnetic valves over the whole area of the jet surface.

As shown in FIG. 6, the supply line of cutting water in the example is comprised by feed line 61 of the pump 60 which takes in seawater and pressurizes it, distribution line 62 corresponding to the row formed by the cutting water jet panel 21 and the sensor block 31, and the water supply branch pipe 23 connected to the cutting water jet panel 21. If the electromagnetic valve is not installed on the water supply branch pipe but only to the distribution pipe 62, for example, the row comprised with four cutting water jet panel 21 becomes the minimum division control unit (the number of sensor block 31 is optional), the number of the electromagnetic valves over the whole jetting surface can be reduced to one fourth as compared to the original example.

However the longer the water supply distance between the location of the electromagnetic valve and the cutting water jet panel, the larger the time lag between the opening of the electromagnetic valve and the jet of the cutting water. Also the smaller the number of the electromagnetic valves, the more limited the control pattern of the cutting water jet.

Considering these points it is important to select the control pattern (cutting water jet pattern) to cut jellyfishes effectively. It is desirable to determine the number and the location of the electromagnetic valves over the whole jetting surface based on this control pattern and then to design the effective supply pipe line of cutting water.

For the explanation purpose, the jetting surface of the cutting water jet system is physically divided to the cutting water jet panel 21 and the sensor block 31 in the example shown and in the figures. However it is obvious that only some control division is necessary to be divided.

As mentioned above the cutting water jet system can select and realize various effective control of the jet cutting water only when the floating materials caught exist on the receiving tray and only to the division part where the floating materials caught exist by combining the area of the cutting water jet panel, the number of the small holes, the combination of the cutting water jet panel and the sensor block, and the number and the location of the installed electromagnetic valves.

What is claimed is:

1. A floating materials removal system, said system comprising:

a) a main rotating removal screen for capturing floating material such as jellyfish, wood chips, waste plastic or other floating items in a body of water, the rotating removal screen comprising an endless belt having an interior belt surface defining an interior region and an exterior belt surface, the main rotating removal screen is adapted to be partially disposed within a body of water and is aligned transverse to flow of water therein;

b) a receiving tray for receiving captured floating materials and conveying the captured floating materials to a discharge line, the receiving tray is disposed within the interior region of the removal screen and above the body of water;

c) a water jet cutting system provided on the receiving tray for selectively cutting captured floating materials, the water jet cutting system having a control system therefor for controlling cutting by the water jet system; and d) a secondary lifting device, the secondary lifting device comprising an endless belt disposed within the interior region of the main rotating removal screen between the receiving tray and the interior belt surface of the main rotating removal screen for transferring floating material from the interior belt surface of the main rotating removal screen to the receiving tray whereby floating material within a body of water is caused to be caught by the main rotating removal screen and lifted to the receiving tray where it is simultaneously cut and released for eventual discharge.

2. A floating materials removal system as in claim 1 and further comprising a water jet dislodging system, the water jet dislodging system provided adjacent the exterior belt surface of the main rotating removal screen and above the receiving tray for applying water jet pressure against the main rotating removal screen for dislodging floating material from the interior belt surface of the main rotating removal tray.

3. A floating materials removal system as in claim 1 and wherein the control system further comprising at least one sensor to detect the captured floating materials, an electromagnetic valve provided in a water supply line for supplying water to the cutting water jet system, and a control circuit to electrically open the electromagnetic valve based on a detecting signal from the at least one sensor to shut the electromagnetic valve following the elapse of a predetermined time period or ending of the detecting signal.

4. A floating material removal system as in claim 3 wherein the at least one sensor is selected from the group consisting of reflecting type sensors and passage type sensors.

5. A floating material removing system as in claim 3 and wherein the control system comprises a plurality of sensors with cooperating electromagnetic valves and control circuits provided in separate regions of the receiving tray to selectively control water jet flow therein.

6. A floating material removal system as in claim 1 and wherein the water jet cutting system includes a series of apertures that extend through the receiving tray and through which high pressure water is conveyed to cut any floating material on the receiving tray and to convey the cut material downstream.

7. A floating material removal system as in claim 6 and wherein the water pressure through the apertures is about 30 atm.

8. A floating material removing system as in claim 1 and wherein the secondary lifting device rotates in the same direction and at the same speed as the main rotating removal screen.

* * * * *